United States Patent [19]

Furbee et al.

[11] Patent Number: 4,799,248

[45] Date of Patent: Jan. 17, 1989

[54] X-RAY TUBE HAVING MULTIPLE CATHODE FILAMENTS

[75] Inventors: Avery D. Furbee, Elmhurst; Salvatore G. Perno, Winfield; James E. Burke, Villa Park, all of Ill.

[73] Assignee: Picker International, Inc., Highland Heights, Ohio

[21] Appl. No.: 82,427

[22] Filed: Aug. 6, 1987

[51] Int. Cl.[4] ..... H05G 1/56; H05J 35/06

[52] U.S. Cl. ..... 378/114; 378/117; 378/134

[58] Field of Search ..... 378/134, 141, 114–116, 378/117–118

[56] References Cited

U.S. PATENT DOCUMENTS

| | | | |
|---|---|---|---|
| 2,141,860 | 12/1938 | Gross et al. | 378/134 |
| 2,875,344 | 2/1959 | Grinerich | 378/117 |
| 3,110,810 | 11/1963 | Fransen | 378/134 |
| 4,017,757 | 4/1977 | De Cou | 378/134 |
| 4,065,689 | 12/1977 | Pleil | 378/134 |
| 4,315,154 | 2/1982 | Weigl et al. | 378/134 |
| 4,685,118 | 8/1987 | Furbee et al. | 378/114 |

*Primary Examiner*—Carolyn E. Fields
*Assistant Examiner*—Joseph A. Hynds
*Attorney, Agent, or Firm*—Watts, Hoffmann, Fisher & Heinke

[57] ABSTRACT

An X-ray tube having two individually energizable cathode filaments. If a primary filament is shorted to a cathode cup, a switch mounted inside the tube housing is thrown to couple a second filament to a filament energization signal. This avoids the necessity in replacing the X-ray tube if the primary filament is shorted and lengthens the effective life of the X-ray tube.

9 Claims, 4 Drawing Sheets

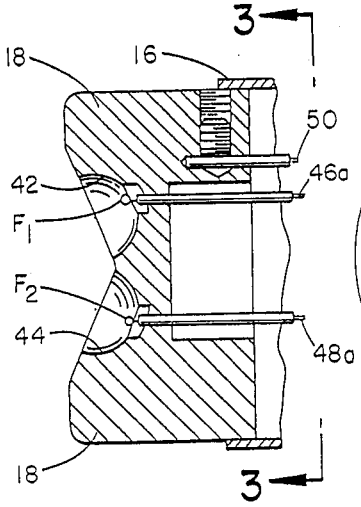
FIG. 2
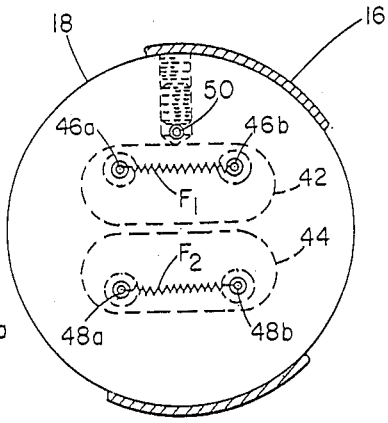
FIG. 3
FIG. 4
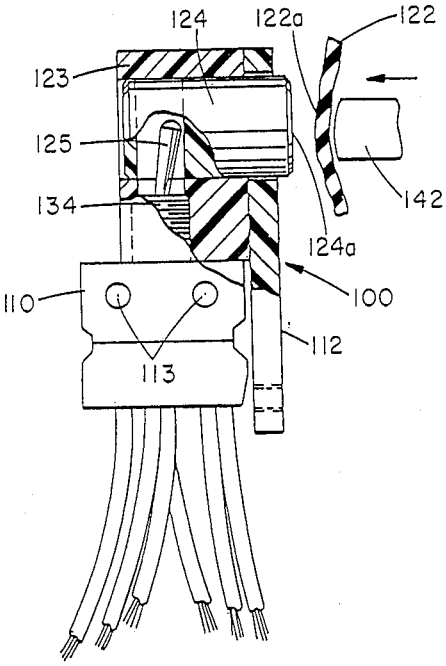
FIG. 5
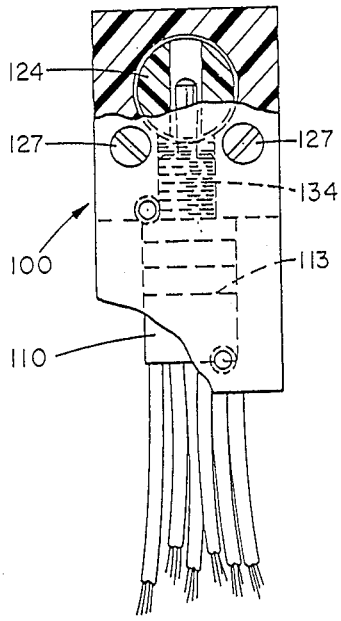

X-RAY TUBE HAVING MULTIPLE CATHODE FILAMENTS

TECHNICAL FIELD

The present invention relates to an X-ray tube having two or more cathode filaments. In the event one filament is shorted a second filament can be activated without replacing the X-ray tube.

BACKGROUND ART

A common failure mode for X-ray tubes, particularly grid controlled tubes, is a short circuit between the cathode filament and the cathode cup to which the filament is mounted. The filament is energized to emit electrons and a potential of several kilovolts is required between the filament and the cathode cup to control the electron beam. Many measures are taken in the design and manufacture of an X-ray tube to prevent tube filaments from shorting since this is a catastrophic failure, requiring the replacement of the X-ray tube. Under certain fault of user conditions, however, the filament may become overheated in localized regions. This situation, in concert with the high electric field can cause the filament to bow into contact with and short circuit the cathode cup, destroying the x-ray tube.

Commonly assigned U.S. patent application Ser. No. 752,311 to Furbee et al. entitled "X-Ray Tube Electron Beam Switching and Biasing Method and Apparatus", now U.S. Pat. No. 4,685,118, discloses certain manufacturing measures that can be taken to reduce the occurrence of X-ray tube filament shorting. The disclosure of this patent is incorporated herein by refernce. Even these measures, however do not entirely eliminate filament shorting.

DISCLOSURE OF THE INVENTION

In accordance with the present invention prior art efforts to eliminate the incidents of filament shorting are supplemented with a high voltage switch mounted inside the X-ray tube housing that allows a back-up filament to be activated. In the event a first filament fails, one or more additional filaments can be utilized without replacing the X-ray tube.

The apparatus of the invention includes an X-ray tube having a cathode and anode. The cathode includes a multiple number of filaments that are mounted to a cathode cup. The X-ray tube is housed within an enclosure which in addition to positioning the X-ray tube for radiating a region of interest, provides high voltage connectors for coupling high voltage energization signals to the X-ray tube cathode and anode. A cathode connector includes several circuit contacts for receipt of a filament energization voltage which typically provides a low voltage a.c. signal imposed upon a hig voltage cathode voltage. Mounted within the tube housing is a circuit for coupling two of these contacts to a selected one of multiple X-ray tube filaments. The circuit includes a switch electrically isolated and operating at cathode potential for selectively routing the energization signal at two connector pin contacts to one of the filaments. The switch includes an actuator which can be controlled from outside the tube housing to select a different one of the multiple filaments if a filament shorts to the cathode cup. The life of the X-ray tube is effectively doubled, tripled, etc. depending upon how many filaments are mounted to the cathode cup.

In accordance with a preferred embodiment of the invention, the tube housing defines an opening to allow access to a switch actuator inside the housing. Toggling of this switch activates a different tube filament. In this way, in the event of a tube failure due to filament shorting, an immediate recovery mode is possible wherein the switch actuator is toggled and a functioning X-ray tube is immediately for use.

Many conventional X-ray tubes now employ insulating fluids within the X-ray tube housing to not only electrically isolate the high voltage X-ray tube, but to dissipate heat away from the tube during X-ray production. A typical prior art tube, therefore includes an expansion bellows mounted within the X-ray tube housing to accommodate fluid expansion and contraction with temperature. This bellows in one embodiment comprises a flexible wall at the cathode end of the tube housing. In a preferred embodiment of the present invention, the switch actuator is mounted in close proximity to this flexible wall so that it can be toggled on and off through the flexible wall. A user gains entry to the housing through an opening in proximity to the flexible expansion wall and contacts a specified location of the wall with an elongated rod. Pressure against the wall applied by the rod causes the wall to deform, contact the switch actuator, and actuate the switch.

A preferred cathode contructed in accordance with the invention has two filaments. The filaments are identical and are mounted in symmetric positions in relation to a cathode cup centerline. Both filaments produce essentially identical focal spots on the X-ray tube anode. The two filaments are therefore functionally equivalent so that tube operation will remain uneffected when the second filament is activated.

From the above it is appreciated that one object of the invention is an X-ray tube having multiple cathode filaments, wherein a backup filament can be activated without replacing the X-ray tube in the event of a short circuit in the primary filament. This and other objects, advantages and features of the invention will become better understood from a detailed description of a preferred embodiment of the invention which is described in conjunction with the accompanying drawings.

BRIEF DESCRIPTION OF THE DRAWINGS

FIG. 2 is a sectioned elevation view of an X-ray tube cathode;

FIG. 3 is a diagrammatic schematic showing relative positioning of two cathode filaments supported by the FIG. 2 cathode;

FIG. 4 is a partially sectioned elevation view of a filament switch assembly that is mounted inside the FIG. 1 X-ray tube housing;

FIG. 5 is a partially sectioned front elevation view of the FIG. 4 switch assembly;

BEST MODE FOR CARRYING OUT THE INVENTION

Figure 1:
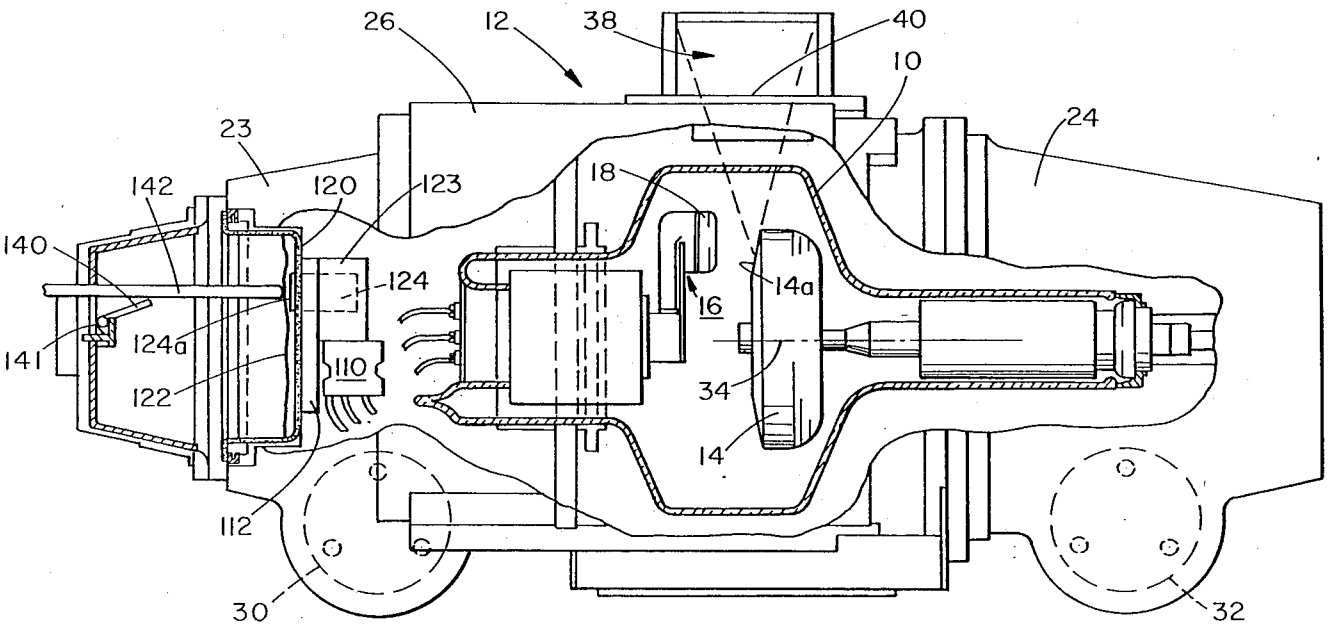
FIG. 1 is a partially sectioned elevation view of an X-ray tube housing supporting an X-ray tube.

Turning now to the drawings, FIG. 1 discloses an X-ray tube 10 mounted within an X-ray tube housing 12. The X-ray tube 10 includes a anode 14 having an anode surface 14a facing an X-ray tube cathode 16 including a specifically configured cathode cup 18 (FIG. 2). As is well known in the prior art, a cathode filament mounted to the cathode cup 18 is energized to emit electronswhich are accelerated to the anode 14 to produce x-radiation for diagnostic imaging, therapy treatment, and the like. The cathode cup 18 acts as a grid to focus electrons to a focal spot on the anode 14.

The tube housing 12 comprises two end portions 23, 24 and an intermediate or middle portion 26. The intermediate portion is coupled to the end portions by fluid tight seals to allow the X-ray tube housing 10 to be filled with an insulting fluid, typically oil. The end portions 23, 24 define high voltage connector sockets 30, 32 which transmit high voltages inputs to the X-ray tube 10 through pin contacts.

The X-ray tube anode 14 is mounted for rotation about an axis 34. Both the rotating anode 14 and a fixed cathode 16 are mounted within an evacuated glass envelope. Electrons emitted by a cathode filament accelerate towards a target or focal spot on the anode and cause X-rays 38 to be emitted. The anode 14 is rotated in a conventional manner to distribute the heating about the anode circumference.

The intermediate portion 26 of the X-ray tube housing 12 includes an X-ray transmissive window 40 of aluminum. The window 40 is in alignment with the anode focal spot from which the X-rays 38 are emitted so that the X-rays pass through the window to the exterior of the housing.

Further details regarding the construction and arrangement of an X-ray tube housing may be obtained by referring to either U.S. Pat. Nos. 3,859,534 to Laughlin or 4,097,759 to Furbee et al, both of which have been assigned to the Picker International, Inc. assignee of the present invention. Those patents are incorporated herein by reference.

A preferred cathode cup 18 is illustrated in FIG. 2. This cup 18 is made of nickel and defines two transverse cavities or slots 42, 44. The FIG. 2 cathode cup supports two separate energizable filaments F1, F2. Conductors 46a, 46b, 48a, 48b for energizing the filaments are routed through the cathode cup 18 to the respective filaments F1, F2.

The two filaments F1, F2 are of the same length, of the same material, and are oriented relative the anode in the same way so energization of either filament produces essentially the same size and shape focal spot at the same location on the anode 14. A grid potential is applied to the cathode cup 18 by an additional conductor 50. When the grid potential is applied it turns off the electron beam. When the grid potential is removed the electron beam is turned on.

Figure 12:
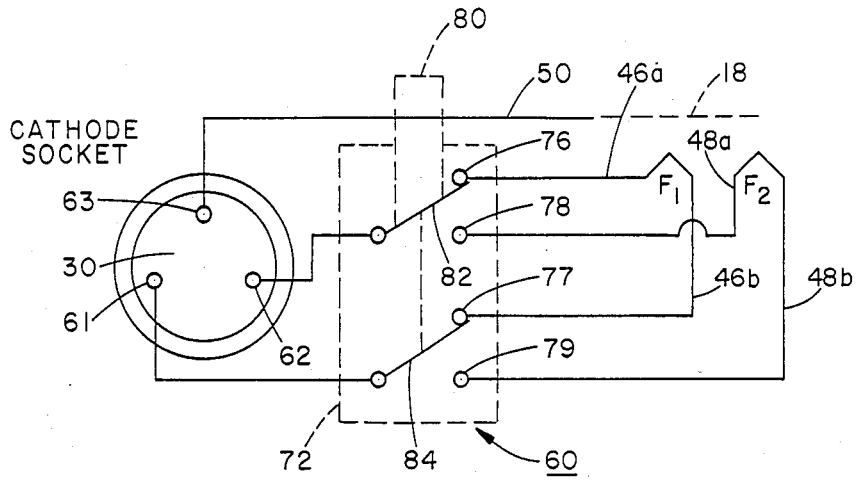
FIG. 12 is a circuit diagram showing circuitry coupled to a high voltage cathode connector for energizing two X-ray tube filaments.

Turning now to FIG. 12, an energization circuit 60 is seen coupled to the two filaments F1, F2. The circuit has three inputs to the cathode connector 30 at three pin contacts 61–63. One contact 63 is directly coupled to the cathode cup 18 by the conductor 50. Voltage on this conductor 50 is controlled from outside the X-ray tube housing to regulate electron flow from the cathode filaments to the anode.

A double pole, double throw switch 72 interposed between the two cathode contacts 61, 62 and the filaments F1, F2 selectively energizes one or the other of the two filaments. The switch 72 defines switch contacts 76, 77 coupled across one filament F1, and additional contacts 78, 79 coupled across a second filament F2. When first installed, the first filament F1 is the primary filament and is energized by the switch 72 until a short circuit or other fault condition in the filament F1 is noted. Rather than replace the X-ray tube if this occurs, a switch actuator 80 moves two switch arms 82, 84 to cause the contacts 61, 62 to be coupled to the switch contacts 78, 79 thereby energizing the second filament F2.

Figure 6:
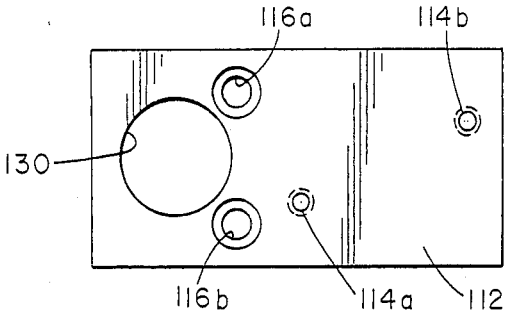
FIG. 6 is a plan view of a bracket for mounting to switch assembly.
Figure 7:
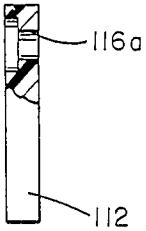
FIG. 7 is a partially sectioned end elevation view of the FIG. 6 bracket.
Figure 8:
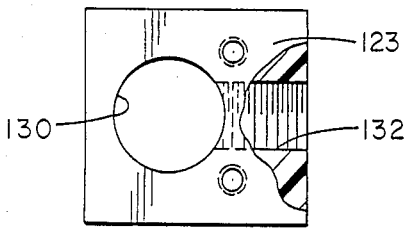
FIG. 8 is a plan view of a switch support for connecting a switch to the FIG. 6 bracket.
Figure 9:
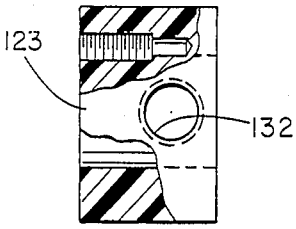
FIG. 9 is a partially sectioned end elevation view of the FIG. 8 switch support.
Figure 11:
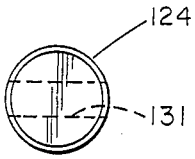
FIG. 11 is an end elevation view of the FIG. 10 push button actuator.
Figure 10:
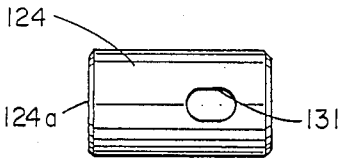
FIG. 10 is an elevation view of a push button plunger for toggling a switch actuator.

A switch assembly 100 is depicted in FIGS. 4 and 5. The assembly includes a switch body 110 that houses a double pole, double throw toggle switch commercially available from Arrow-Hart under part no. 82611. A switch mounting bracket 112 supports the switch body 110 inside the X-ray tube housing 12. The switch body 110 defines holes 113 to allow fluid dielectric to enter the body 110, come in contact with, and insulate the switch contacts 76–79. The bracket 112 (FIG. 6) defines two sets of openings 114a, 114b, 116a, 116b. The first set of openings 114a, 114b accommodate threaded connectors utilized in mounting the bracket 112 to a bellows retaining bracket 120 (FIG. 1) fixed inside the X-ray tube housing 12. An expansion bellows 122, also within the housing 12, defines a flexible retaining wall for confining insulating fluid with the housing. The second set of openings 116a, 116b accommodate connectors 127 connect a switch support 123 to the bracket 112.

As shown most clearly in FIG. 4, the switch actuator 80 includes a cylinder-like push button plunger 124 that engages a switch toggle arm 125 to move the switch arms 82, 84. During installation of the switch assembly 100 the push button plunger 124 is inserted into a through passage 130 defined by the assembled combination of the bracket 112 and switch support 123 until a passageway 131 in the push button plunger 124 is positioned to receive the switch toggle 125. The toggle 125 is inserted into a threaded opening 132 defined by the switch support 123 until a threaded connector 134 (FIG. 4) extending from the switch body 110 contacts the support 123. The connector 134 is then threaded into the support 123 until the switch body 110 contacts the support 123 with the toggle 125 oriented for actuation in response to contact with the push-button 124. The switch assembly 100 is then mounted to the bellows retaining bracket 120 so that a contact surface 124a of the plunger 124 faces the flexible bellows 122. As seen most clearly in FIG. 1 the push-button extends through the bracket 120 to a position in close proximity to the flexible bellows 122.

To activate the switch 72, a lead cover 140 pivotally mounted to the housing 12 by a hinge and biased to a closed position by a spring 141 is pivoted away from its closed position by a rod 142 that is pushed into the housing 12 to engage the bellows 122 and deform the bellows until an inner bellows surface 122a contacts the plunger contact surface 124a. Continued inward movement of the rod pushes the plunger against the toggle 125 and moves the switch arms 82, 84 to the alternate filament contacts 78, 79.

The preferred switch assembly components are constructed of nylon or Lexan. This material is used for ease of machinability and high temperature electrical isolation. Other suitable materials are available. While two filaments F1, F2 are used in a preferred design, three or more filaments might be used with alternate configuration cathode cups. It is the intent that the invention include all modifications from the disclosed preferred design falling within the spirit or scope of the appended claims.

We claim:

1. Apparatus comprising:

(a) X-ray generating means including a cathode and an anode mounted in an evacuated chamber, said cathode having multiple filaments for emitting electrons to impinge upon a target region of said anode;

(b) housing means enclosing the X-ray generating means in an enclosure containing an insulating fluid and including a flexible wall member in part defining said enclosure to accommodate variations in the volume of said insulating fluid with temperature, said housing means supporting said X-ray generating means in a position to direct X-rays through a region of interest;

(c) connector means coupled to the housing means for energizing the X-ray generating means and having two conductors for receipt of a filament energization voltage; and (d) selector means immersed within said insulating fluid for electrically coupling the filament energization voltage at the connector means across a selected one of said multiple filaments while electrically isolating others of said multiple filaments from said filament energization voltage and having an actuator that includes a movable contact element in close proximity to said flexible wall which can be controlled from outside the housing means to energize different ones of said multiple filaments;

(e) said housing means including an opening for insertion of a tool to engage said flexible wall in the region of said selector means to cause said flexible wall to contact and to move the movable contact element and select a different one of the multiple filaments.

2. The apparatus of claim 1 wherein said cathode includes a filament mounting assembly having multiple elongated slots for orienting each of the multiple filaments to produce substantially similar focal spots on the anode when energized with said energization voltage.

3. The apparatus of claim 1 wherein the cathode includes two filaments and the selector means comprises a double pole double throw switch to electrically isolate both ends of one filament from the filament energization voltage while coupling said energization voltage across a second of said two filaments.

4. Apparatus comprising:

(a) X-ray generating means including a cathode and an anode mounted in an evacuated chamber, said cathode including multiple filaments and a filament mounting assembly to position said multiple filaments relative the anode to cause electrons emitted by said multiple filaments to impinge upon a target region of said anode;

(b) housing means enclosing the X-ray generating means in an enclosure containing an insulating fluid, said enclosure defined in part by a flexible wall member to accommodate variations in the volume of said insulating fluid with temperature, said housing means supporting said X-ray generating means in a position to direct X-rays from the target region of said anode through a region of interest;

(c) connector means coupled to the housing means for energizing the X-ray generating means including two conductors for receipt of a filament energization voltage and a third conductor for receipt of a bias voltage for the filament mounting assembly; and (d) selector means immersed within the insulating fluid for electrically coupling the filament energization voltage at the connector means across a selected one of said multiple filaments, and having an actuator including a movable contact element in close proximity to said flexible wall member which can be controlled from outside the housing means to energize different ones of said multiple filaments in the event of a short between a filament and said filament mounting assembly;

(e) said housing means including an opening for insertion of a tool to engage said flexible wall member and operate the movable contact element by contact through said flexible wall member.

5. A method for generating X-radiation comprising the steps of:

(a) mounting an X-ray tube having two cathode filaments inside an X-ray tube housing enclosure defined in part by a flexible wall, said two cathode filaments positioned in relation to an X-ray tube anode to produce equivalent focal spots on an X-ray tube anode when energized;

(b) at least partially insulating the X-ray tube by filling the enclosure with a dielectric fluid whose volume changes with temperature are accommodated by the flexible wall;

(c) routing filament energization signals inside the X-ray tube housing;

(d) coupling the energization signals across a primary filament to operate the X-ray tube until a malfunction of said primary filament occurs by routing the energization signals through switch contacts of a double pole, double throw mechanical switch immersed within the dielectric fluid; and (e) removing the filament energization signals from both ends of said primary filament and coupling the energization signals across a secondary filament to extend the operating life of the X-ray tube in the event of a short of the primary filament by moving the flexible wall into engagement with a switch actuator of said double pole, double throw mechanical switch.

6. The method of claim 5 wherein the two cathode filaments are mounted to a cathode cup and the cathode cup is biased by a biasing means for routing voltage inside the X-ray tube housing.

7. Apparatus comprising:

(a) an X-ray tube including a cathode and an anode mounted in an evacuated chamber, said cathode having multiple filaments for emitting electrons to impinge upon a target region of said anode;

(b) a housing enclosing the X-ray tube in an enclosure containing an insulating fluid and including a wall that in part defines said enclosure and is accessible from outside said housing, said housing supporting said X-ray tube in a position to direct X-rays through a region of interest;

(c) an electrical connector coupled to the housing for energizing the X-ray tube and having two conductors for receipt of a filament energization voltage; and (d) a filament selector switch means mounted to the housing in said close proximity to an inner surface of said wall and immersed within said insulating fluid for electrically coupling the filament energization voltage from the electrical connector across a selected one of said multiple filaments while electrically isolating both ends of others of said multiple filaments from said filament energization voltage and having a switch actuator that can be operated through said wall to couple the filament energization voltage across others of said multiple filaments in the event of a failure of said selected one filament.

8. The apparatus of claim 7 wherein there are two filaments and the filament selector switch comprises a double pole, double throw switch coupled to the two filaments.

9. The apparatus of claim 7 wherein the wall comprises a flexible wall to accommodate changes in volume of said insulating fluid with temperature and wherein the switch actuator is a moveable actuator that is operated by moving the flexible wall into contact with said switch actuator by applying a force against an outside surface of said flexible wall.

* * * * *